United States Patent [19]

Nichols et al.

[11] Patent Number: 4,715,390

[45] Date of Patent: Dec. 29, 1987

[54] MATRIX ENTRAPMENT OF FLAVORINGS FOR SMOKING ARTICLES

[75] Inventors: Walt Nichols; Reggie Newsome, both of Richmond; Rich Thesing, Glenn Allen; Willie Houck, Richmond, all of Va.

[73] Assignee: Philip Morris Incorporated, New York, N.Y.

[21] Appl. No.: 799,750

[22] Filed: Nov. 19, 1985

[51] Int. Cl.[4] ..... A24B 3/12; A24B 13/00

[52] U.S. Cl. ..... 131/335; 131/337; 131/352

[58] Field of Search ..... 131/335, 337, 352

[56] References Cited

U.S. PATENT DOCUMENTS

| | | |
|---|---|---|
| 1,507,925 | 6/1924 | Marshall . |
| 2,137,706 | 11/1938 | Ubben . |
| 2,746,890 | 6/1956 | Legler . |
| 2,813,051 | 12/1958 | MacHenry . |
| 2,992,647 | 7/1960 | Figge . |
| 3,137,631 | 6/1964 | Soloway . |
| 3,144,024 | 9/1964 | Eichwald . |
| 3,162,199 | 11/1964 | Moll . |
| 3,334,636 | 12/1967 | Zuber . |
| 3,397,700 | 1/1968 | Harlow . |
| 3,428,049 | 1/1969 | Leake . |
| 3,511,247 | 9/1970 | Tamol . |
| 3,526,904 | 2/1971 | Tamol . |
| 3,540,456 | 5/1971 | McGlumphy . |
| 3,550,598 | 6/1971 | McGlumphy . |
| 3,603,319 | 12/1971 | Badgett . |
| 3,623,489 | 1/1972 | Quinn . |
| 3,688,985 | 6/1972 | Engel . |
| 3,941,858 | 3/1976 | Shepherd et al. . |
| 4,212,310 | 7/1980 | Van Auken et al. . |
| 4,340,072 | 7/1982 | Bolt et al. . |
| 4,434,804 | 3/1984 | Bolt et al. . |
| 4,452,260 | 6/1984 | Porenski et al. . |

FOREIGN PATENT DOCUMENTS

| | | |
|---|---|---|
| 722697 | 7/1972 | South Africa . |

*Primary Examiner*—V. Millin

[57] ABSTRACT

A novel composition for flavoring smoking articles contains a soluble flavoring material, an appropriate solvent for the flavoring material, triacetin and a moisture-releasing hydrophilic polymer. Smoking articles containing the composition and methods for making such smoking articles are disclosed.

30 Claims, No Drawings

MATRIX ENTRAPMENT OF FLAVORINGS FOR SMOKING ARTICLES

The present invention relates generally to smoking articles, and more particularly to a means for stably entrapping a flavor in smoking articles for release upon smoking.

BACKGROUND OF THE INVENTION

Flavorants are commonly added to cigarettes and other smoking articles, during the manufacturing process to achieve desired taste and smell sensations during smoking. Many tobacco flavoring materials, including the commonly employed menthol flavorant, however, are volatile and tend to vaporize and gradually escape from the cigarette between the time the cigarette is made and the time it is smoked.

One method employed to compensate for this loss of flavorant over storage time involved applying a greater amount of the flavoring material to the cigarette during its manufacture. However, when the cigarette is stored for an extended period or subjected to varying conditions of temperature and humidity prior to smoking, a significant loss of flavor occurs resulting in failure to achieve the desired taste and smell sensations upon smoking.

Other flavor release methods which have been employed in smoking materials fall into four categories, including the use of compounds or complexes which decompose to release the flavorant, the use of capsules rupturable upon the manual application of pressure thereof which contain the flavorant, flavorants, releasable upon thermal activation and encapsulated flavors released by moisture application.

In one exemplary cigarette construction described in U.S. Pat. No. 3,006,347, a flavor is encapsulated in a film forming vehicle having as its basic chemical constituent a polysaccharide, a polypeptide, or mixtures thereof. The encapsulated flavor is applied to the cigarette paper. The flavor is released by heating the vehicle to a temperature sufficiently high to degrade the film-forming vehicle structure. Thus, the useful application of the flavor and vehicle is limited to only those regions of the cigarette that will experience sufficiently high temperatures during smoking, such as the tobacco filler itself or the cigarette paper surrounding the filler. Moreover, the temperatures required to destroy the vehicle structure and release the flavor are sufficiently high to permit flavor release only in the vicinity of the coal. Thus, the flavor must be applied along the whole length of the tobacco rod wrapper to ensure a consistent level of release and delivery of flavor during smoking. Such a vehicle is difficult to apply to the cigarette paper during cigarette manufacture.

There remains, therefore, a need in the art for methods and materials enabling the retention of volatile flavoring materials in smoking articles under a variety of storage conditions and durations.

SUMMARY OF THE INVENTION

The present invention alleviates to a great extent the shortcomings of known tobacco flavoring methods by providing in one aspect a composition capable of stably entrapping and progressively releasing flavor in smoking articles. More specifically, the invention provides for a flavoring entrapped within a film forming composition that progressively releases the flavoring upon reaction with water vapor present in the smoke. The composition involves an admixture of a selected soluble flavoring material in an appropriate solvent, an effective amount of triacetin, and a moisture releasing hydrophilic polymer. The composition may also contain an effective amount of water to adjust the admixture to a desired viscosity for application to a smoking article.

The composition may be adapted to contain a variety of conventional flavorings employed in the manufacture of cigarettes, cigars and the like, including menthol, citrus, chocolate, licorice, mint and breath freshener flavors. Similarly, in accordance with the broadly described composition of the present invention, the solvent may be selected from a number of solvents conventionally employed in the tobacco industry, such as alcohols, e.g., ethanol and peppermint oil. It is also possible, depending on the solubility of the flavoring material selected, for the solvent to be triacetin. The polymer is desirably selected from among esters of polyvinyl alcohols, polysaccharides, pectins, gelatins, starches, or mixtures thereof, but may also be any hydrophilic polymer capable of degrading upon contact with moisture laden smoke. Triacetin may also vary in proportion but is essential to the composition. In the absence of triacetin, little, if any, flavoring may be retained in the composition.

The parameters of one desirable embodiment of the composition according to the invention includes between about 1 to 25 parts by weight menthol; between about 1 to 25 parts by weight ethanol; between about 1 to 10 parts by weight triacetin; and between about 20 to 80 parts by weight polyvinylacetate [PVA]. A preferred composition more specifically contains about 2.0 parts by weight menthol, about 1 part by weight ethanol, about 0.5 part by weight triacetin, and about 7 parts by weight polyvinylacetate. To adjust the viscosity of the preferred embodiment about 1–15 parts by weight water may be added thereto. The ethanol content of the composition may be increased if desired, but decreasing the ethanol content may result in undissolved excess methanol.

The ratio of PVA to menthol is preferably about 3.5 parts PVA to 1.0 part menthol. A sufficient amount of the PVA matrix must be present to form a film and retain the menthol. However, increasing the relative amount of PVA proportionately decreases the accessability or release rate of the menthol, because increased moisture exposure is required to initiate menthol release.

As another aspect of the present invention, a smoking article is provided comprising a source of moisture containing smoke; and a moisture-soluble, film-forming composition comprising a flavoring material as previously described. By utilizing such a moisture release flavor composition, the flavor may be applied at any position on the smoking article where it will be exposed to the moisture carrying smoke. Thus, flavor may be applied to or dispersed in essentially any part of a conventional cigarette, such as in the tobacco filler, in the filter plug on the inside surface of the cigarette paper wrapper surrounding the tobacco filler, or coated on the inside surface of the filter plug wrapper or the tipping paper. Where the filter is fibrous, the composition may be dispersed through at least a portion of it. Alternatively where the filter has at least one cavity, the composition may be located within the cavity. Additionally, the flavor-containing composition may be applied to other smoking articles such as cigars and cigarillos and the like, and to smoking devices, such as cigarette holders, cigar holders and pipes.

As yet a further aspect of the invention, there is provided a method for making a flavor-releasing smoking article involving a specific sequence of steps. These steps include initially admixing the soluble flavoring material with the selected solvent and then adding triacetin to that mixture. This resulting mixture is added at a slow rate to the moisture-releasing hydrophilic polymer and the final composition is applied to a smoking article where it will be exposed to moisture-containing smoke. The method also includes providing a source of moisture-containing smoke, e.g., a tobacco rod, capable of causing the composition to progressively release the flavoring material.

The applying step of the method may include coating the composition onto the inner surface of the cigarette or filter wrapping paper; dispersing the composition as a foam in the tobacco filler or filter material and locating the composition in a cavity within the filter or tobacco.

The solvents, flavoring materials and polymers described above for use in the composition may similarly be employed in the method. A preferred embodiment of the method provides for admixing about two parts by weight menthol, with at least about one part by weight ethanol; adding about 0.5 part by weight triacetin; and admixing from four to twenty parts by weight polyvinylacetate therewith.

The composition, smoking articles employing the composition, and methods for making the smoking articles of the present invention provide a novel flavoring system for smoking articles which maintains its ability to release flavor for long periods of time under a variety of temperature and humidity conditions. Further, the methods and materials of the invention provide a flavoring system which also yields the selected flavor progressively during smoking.

Other aspects and advantages of the present invention will be readily apparent upon consideration of the following detailed description of the preferred embodiments thereof.

DETAILED DESCRIPTION

As previously described, the flavoring composition of the present invention may be applied to parts of the cigarette other than the plug wrap which are exposed to the moisture carrying cigarette smoke. For example, a composition according to the present invention may be applied within the filter itself, dispersed or concentrated in discrete regions therein or in other parts of the cigarette. Moreover, a compound filter element may be employed in which one portion contains the composition.

The following examples illustrate practice of the invention in the production of compositions and smoking articles for retention of flavor under variant conditions and for progressive delivery of the flavor during smoking:

EXAMPLE 1

In one preferred embodiment of the present invention, the flavor composition can be applied as a coating on the inside of the plug wrap of a filter cigarette.

In a typical filter cigarette, a tobacco column is overwrapped by a cigarette wrapper which is adhered to itself at an adhesive seam. Filter plug material is overwrapped by a plug wrapper, which is also adhered to itself at a seam. Another optional adhesive seam serves to adhere the plug wrapper to the filter plug. Tripping paper adheringly overwaraps and joins the plug wrap and cigarette wrapper.

The plug wrap may be coated with the composition solution prior to its incorporation into the cigarette. If the coated plug wrap is applied to the filter plug material before the coating dries, the coating may soak into the surface of the filter plug to some extent. Thus, the coating may also aid the adherence of the plug wrap to the filter plug. Any effect on the the porosity through the plug wrap to the filter plug may be accounted for in vented filter constructions.

EXAMPLE 2

The storability and delivery of a smoking article according to the present invention was observed by coating a cigarette plug wrap on one side with the following composition: Five milligrams of menthol was solubilized with fifteen grams of ethanol (95 percent solution) and then mixed with fifteen grams of triacetin. This mixture was then warmed slightly above room temperature. Five grams of this solution was admixed with ten grams of PVA. The resulting mixture was applied to the cigarette plug wrap and allowed to dry. The plug wrap was wrapped around cellulose acetate filter plugs with the coated side toward the filter. The wrapped filters were stored in boxes for about two months, and then formed into cigarettes. While the cigarettes were being smoked the menthol content on a puff by puff basis was recorded as shown in Table I below.

TABLE I

| puff | 1 | 2 | 3 | 4 | 5 | 6 | 7 | 8 |
|---|---|---|---|---|---|---|---|---|
| menthol (mg/puff) | .02 | .03 | .03 | .03 | .04 | .05 | .07 | .12 |

A further feature of the flavor delivery composition according to the invention is illustrated in this example. As shown in the results tabulated above, a significant increase in flavor delivery levels occurs from the sixth to the ninth puff of a cigarette prepared as described above. Consequently, the composition may be applied to the cigarette in reduced quantities such that the level of flavor delivery during the early puffs is below the taste threshold and that only during the sixth to ninth puff, when the flavor delivery increases, is the flavor level sufficient to exceed the taste threshold. For example, the taste threshold for menthol is about 0.025 milligram per puff. By timing delivery in this way, a flavor, such as a breath freshener, may be delivered only at the end of the cigarette. This effect may also be utilized in smoking articles other than cigarettes.

A similar effect is achieved by increasing the proportion of PVA in the solution. The accessibility of the flavor is decreased and during initial puffs, the flavor delivery is below the taste threshold. During the last puff or puffs however, sufficient moisture has been provided to the flavoring system to release menthol above the threshold taste level.

EXAMPLE 3

To determine the effectiveness of the composition in retaining the flavoring under a variety of storage conditions, the following study was conducted. A composition according to the present invention was prepared by mixing together on a weight basis ratio, about 2.0 parts menthol, about 1.0 part ethanol, and about 0.5 part triacetin. PVA was admixed in the solution at a ratio of about 3.5 parts PVA to about one part menthol. Water was also added at a ratio of about 1.5 parts $H_2O$ to 2.0 parts menthol to adjust the viscosity of the composition.

Plug wrap was coated on one side with the mixture and used to wrap cellulose acetate filter plugs (21 mm in length and 25 mm in circumference) with the coated side toward the filter. Average total weight of about 35.5 milligrams of coating (to yield an average application of 5.9 milligrams of menthol) was evenly applied to each plug wrap. Cigarettes were made by joining the filters to 63 mm tobacco rods and were divided into two groups.

One group of cigarettes was placed in a room at lab conditions of 75° F. and 60% relative humidity, the other group was placed in a room at desert conditions of 110° F. and 15% relative humidity. A number of coated cigarettes having the same structure and blend and having about 5.9 milligrams of menthol evenly added to the filler were placed in each of the rooms at the same time. All cigarettes were sealed in packs. Initially, and at periodic intervals, cigarettes were removed from the rooms and analyzed for menthol content in the smoke. The results of these studies are shown in Table II.

TABLE II

| Days Stored | Sample Type | Mg Menthol In All Puffs | Mg Menthol/Puff Puff Number 1 | 2 | 3 | 4 | 5 | 6 | 7 | 8 | 9 |
|---|---|---|---|---|---|---|---|---|---|---|---|
| Lab Room Conditions | | | | | | | | | | | |
| 0 | Control | 0.57 | (a) | .06 | .06 | .07 | .08 | .08 | .08 | .08 | .08 |
| | Experimental | 0.68 | .04 | .04 | .04 | .04 | .04 | .05 | .06 | .09 | .15 |
| 20 | Control | 0.63 | .02 | .04 | .06 | .06 | .07 | .08 | .09 | .08 | .09 |
| | Experimental | 0.68 | .02 | .04 | .04 | .04 | .05 | .06 | .07 | .10 | .18 |
| 29 | Control | 0.58 | .04 | .05 | .06 | .07 | .08 | .08 | .09 | .09 | .08 |
| | Experimental | 0.70 | .03 | .04 | .04 | .05 | .05 | .05 | .08 | .13 | .21 |
| 57 | Control | 0.58 | .03 | .05 | .05 | .06 | .06 | .06 | .07 | .07 | (a) |
| | Experimental | 0.73 | .04 | .04 | .04 | .04 | .05 | .05 | .07 | .10 | .14 |
| 85 | Control | .046 | (b) | | | | | | | | |
| | Experimental | .058 | (b) | | | | | | | | |
| 168 | Control | 0.42 | (b) | | | | | | | | |
| | Experimental | 0.64 | (b) | | | | | | | | |
| Desert Conditions | | | | | | | | | | | |
| 8 | Control | 0.47 | (a) | .04 | .04 | .05 | .06 | .06 | .06 | .07 | .11 |
| | Experimental | 0.62 | .04 | .04 | .05 | .05 | .05 | .06 | .06 | .09 | .15 |
| 27 | Control | 0.38 | .03 | .04 | .05 | .05 | .06 | .06 | .08 | .12 | (a) |
| | Experimental | 0.65 | .05 | .07 | .06 | .07 | .08 | .09 | .13 | .19 | (a) |
| 37 | Control | 0.46 | (b) | | | | | | | | |
| | Experimental | 0.5 | (b) | | | | | | | | |
| 76 | Control | 0.32 | (b) | | | | | | | | |
| | Experimental | 0.69 | (b) | | | | | | | | |
| 114 | Control | 0.26 | .03 | .04 | .05 | .06 | .07 | .07 | .09 | (a) | (a) |
| | Experimental | 0.54 | .04 | .08 | .07 | .08 | .10 | .12 | .17 | (a) | (a) |
| 168 | Control | 0.28 | (b) | | | | | | | | |
| | Experimental | 0.57 | (b) | | | | | | | | |

(a)No data point collected.
(b)Puff by puff data not available.

The tabulated results unexpectedly illustrate good flavor retention and delivery during smoking in both desirable laboratory conditions and harsh desert conditions.

EXAMPLE 4

Yet another composition according to the present invention was developed and tested for flavor delivery. A composition was prepared by mixing together on a weight basis ratio about 2.0 parts menthol, about 1.0 part ethanol, and about 1.0 part triacetin. To this is added about 16.0 parts PVA and about 1.5 parts water. Cigarettes were made as in Example 3 with an average total weight of about 8–10 milligrams per cavity evenly coated on each plug wrap. The cigarettes were smoked and the menthol content on a puff by puff basis was as shown in Table III.

TABLE III

| puff | 1 | 2 | 3 | 4 | 5 | 6 | 7 |
|---|---|---|---|---|---|---|---|
| menthol (mg/puff) | .01 | .02 | .02 | .02 | .04 | .04 | .06 |

The results demonstrate a consistent delivery of flavor over time, with the heaviest delivery occurring in the later draws upon the cigarette.

EXAMPLE 5

A flavoring composition according to the present invention may also be coated on part of the cigarette other then the plugwrap, such as the filter fibers. Even when only the plugwrap is coated as the PVA film dries, some of the menthol in the composition may migrate into the cellulose acetate filter fibers or into the filler.

Cigarettes were produced on Day 1 using a flavoring composition applied to filler, filter and plugwrap in two different concentrations. A flavoring composition of 7 parts PVA, 2 parts menthol, 1 part ethyl alcohol, 0.5 parts triacetin and 1.5 parts water was applied to two sets of cigarettes at coating weights of (A) 5.0 grams of solution/25 rods or 74.7 grams of solution/$m^2$ plug wrap and (B) 2.5 grams solution/25 rods or 37.35 grams of solution/$m^2$ plug wrap.

Table IV below illustrates the "storability" of such a flavorant over time and in various parts of the cigarette.

TABLE 4

| Storage Time | Sample Type | Mg Menthol | Mg Menthol/Puff Puff No. 1 | 2 | 3 | 4 | 5 | 6 | 7 |
|---|---|---|---|---|---|---|---|---|---|
| 1 month | A - Smoke | .63 | .05 | .07 | .07 | .08 | .08 | .11 | .18 |
| 1 month | B - Smoke | .42 | .02 | .04 | .04 | .05 | .06 | .07 | .11 |

TABLE 4-continued

| Storage Time | Sample Type | Mg Menthol | Mg Menthol/Puff Puff No. 1 | 2 | 3 | 4 | 5 | 6 | 7 |
|---|---|---|---|---|---|---|---|---|---|
| 11 months | A - Smoke | .66 | .06 | .08 | .08 | .08 | .09 | .12 | .14 |
| 1 month | A - Filter | 4.98 | | | | | | | |
| 1 month | B - Filter | 2.96 | | | | | | | |
| 11 months | A - Filter | 3.19 | | | | | | | |
| 1 month | A - Plugwrap | 2.09 | | | | | | | |
| 1 month | B - Plugwrap | 2.96 | | | | | | | |
| 11 months | A - Plugwrap | 1.25 | | | | | | | |

A = 5.0 g solution/25 rods
B = 2.5 g solution/25 rods

The unexpected efficacy of the composition of the present invention in retaining flavor over time is clear. In contrast, a conventional commercially-available menthol cigarette experiences a decided decrease in flavor retention over storage time.

In one study, such a conventional cigarette stored in desert conditions of 110° F. and 15% relative humidity, decreased in menthol flavor delivery from 0.57 milligram of menthol in smoke when fresh to 0.24 milligram after six months. A cigarette treated according to the present invention with 74.7 grams of solution per square meter of plugwrap experienced a small decrease over the same time and under the same conditions of 0.63 to 0.57 milligram of menthol in smoke.

EXAMPLE 6

When all the flavorant composition is applied to the center of the filter, delivery of menthol flavor in smoke was found to be equivalent to filters having treated plugwraps only. In this study, the solution described in Example 5 above was applied to the center of the filter at a coating wet weight of 2.5 grams of solution per 25 rods or 37.35 grams/$m^2$ plug.

The analytical data appears in Table V below.

TABLE V

| Sample Type | Mg. Menthol | Mg Menthol/Puff Puff No. 1 | 2 | 3 | 4 | 5 | 6 | 7 |
|---|---|---|---|---|---|---|---|---|
| Smoke | 0.42 | .03 | .05 | .05 | .05 | .06 | .09 | .12 |
| Filter | 3.47 | | | | | | | |
| Plugwrap | 0.14 | | | | | | | |

EXAMPLE 7

As an alternative method of applying flavorant to the center of filter, the PVA-menthol solution of Examples 4 and 5 was applied to the center of a filter made of a low density cellulose acetate. This center was surrounded by a higher-density cellulose acetate with no trace of solution on it. The analytical data after seven days is shown below in Table VI.

TABLE VI

| Sample Type | Mg. Menthol | Mg Menthol/Puff Puff No. 1 | 2 | 3 | 4 | 5 | 6 | 7 | 8 |
|---|---|---|---|---|---|---|---|---|---|
| Smoke | 0.45 | .03 | .04 | .05 | .06 | .07 | .07 | .08 | .07 |
| Filter | 2.8 | | | | | | | | |

Numerous modifications and variations in practice of the invention are expected to occur to those skilled in the art upon consideration of the foregoing descriptions of preferred embodiments thereof. Among such modifications are the use of flavorants other than menthol, e.g., citrus, chocolate and other commonly employed cigarette flavorings and breath fresheners, and the substitution of other solvents or moisture-reactive polymers or substances such as polysaccharides, starches, pectins and mixtures thereof. It is apparent that various changes and modifications may be made in the invention without departing from the scope of the invention as defined by the claims appended thereto.

What is claimed is:

1. A composition capable of progressively releasing flavor in smoking articles upon contact with moisture-containing smoke comprising an admixture of:
- a selected soluble flavoring material;
- a solvent for said flavoring material;
- a moisture releasing hydrophilic polymer; and
- an amount of triacetin effective to retain the flavoring material in the composition.

2. The composition according to claim 1, further comprising an effective amount of water to adjust said admixture to a desired viscosity.

3. The composition according to claim 1, wherein said flavoring material is selected from the group consisting of menthol, citrus, chocolate, licorice, mint and breath freshener flavors.

4. The composition according to claim 1, wherein said solvent is an alcohol.

5. The composition according to claim 1, wherein said hydrophilic polymer is selected from the group consisting of esters of polyvinyl alcohols, polysaccharides, pectins, gelatins, starches and mixtures thereof.

6. The composition according to claim 1, comprising between about 1 to 25 parts by weight menthol; between about 1 to 25 parts by weight ethanol; between about 1 to 10 parts by weight triacetin; and between about 20 to 80 parts by weight polyvinylacetate.

7. The composition according to claim 6, comprising about 2.0 parts by weight menthol, about 1 part by weight ethanol, about 0.5 part by weight triacetin, and about 7 parts by weight polyvinylacetate.

8. The composition according to claim 6 or 7, further comprising about 1 to 15 parts by weight water.

9. A smoking article comprising:
- a source of moisture containing smoke; and
- a moisture-soluble, film-forming composition comprising an admixture of:
- a selected soluble flavoring material;
- a solvent for said flavoring material;
- a moisture releasing hydrophilic polymer; and
- an amount of triacetin effective to retain the flavoring material in the composition.

10. The smoking article according to claim 9 further comprising a filter, said composition being located within said filter.

11. The smoking article according to claim 10, wherein said filter is fibrous and said composition is dispersed through at least a portion of said filter.

12. The smoking article according to claim 10, wherein said filter has at least one cavity and said composition is located within said cavity.

13. The smoking article according to claim 10, wherein said filter comprises a filter core at least partially wrapped on its outer periphery by a wrapping paper having said composition coated onto the inside surface thereof.

14. The smoking article according to claim 9, further comprising one or more components selected from the group consisting of filter paper, cigarette wrapping paper, tipping paper, tobacco, non-tobacco tow material.

15. The smoking article according to claim 14, wherein said composition is coated or dispersed through one or more of said components.

16. The smoking article according to claim 9, wherein the composition further comprises an effective amount of water to adjust said admixture to a desired viscosity.

17. The smoking article according to claim 9, wherein the flavoring material in the composition is selected from the group consisting of menthol, citrus, chocolate, licorice, mint and breath freshener flavors.

18. The smoking article according to claim 9, wherein the solvent in the composition is alcohol.

19. The smoking article according to claim 9, wherein the hydrophilic polymer in the composition is selected from the groups consisting of esters of polyvinyl alcohols, polysaccharides, pectins, gelatins, starches and mixtures thereof.

20. The smoking article according to claim 9 wherein the composition comprises between about 1 to 25 parts by weight menthol; between about 1 to 25 parts by weight ethanol; between about 1 to 10 parts by weight triacetin; and between about 20 to 80 parts by weight polyvinylacetate.

21. The smoking article according to claim 20 further comprising about 1 to 15 parts by weight water.

22. The smoking article according to claim 9 wherein the composition comprises about 2.0 parts by weight menthol, about 1 part by weight ethanol, about 0.5 part by weight triacetin, and about 7 parts by weight polyvinylacetate.

23. The smoking article according to claim 21 further comprising about 1 to 15 parts by weight water.

24. A method for making a flavor-releasing smoking article comprising the steps of:

a. admixing a soluble flavoring material with a solvent;
b. adding triacetin to the mixture of step (a);
c. admixing the mixture of step (b) at a slow rate with a moisture releasing hydrophilic polymer;
d. applying the final mixture of step (c) to a smoking article where it will be exposed to moisture containing smoke; and
e. providing a source of moisture-containing smoke capable of causing said mixture to progressively release said flavoring material.

25. The method according to claim 24, wherein said solvent is an alcohol.

26. The method according to claim 24, wherein said flavoring material is selected from the group consisting of menthol, citrus, chocolate, licorice, mint and breath freshener flavors.

27. The method according to claim 24, wherein said polymer is selected from the group consisting of esters of polyvinyl alcohols, polysaccharides, pectins, gelatins and starches and mixtures thereof.

28. The method according to claim 24, wherein said applying step comprises a method selected from the group consisting of (a) coating said final mixture to the inner surface of the cigarette or filter wrapping paper; (b) dispersing said final mixture as a foam in the tobacco filler or filter material of said smoking article; and (c) locating said final mixture in a cavity within said filter or tobacco.

29. The method according to claim 24, wherein step (a) comprises admixing about two parts by weight menthol, with at least about one part of weight ethanol; step (b) comprises adding about 0.5 part by weight triacetin; and step (c) comprises admixing from four to twenty parts by weight polyvinylacetate with the mixture from (b).

30. The method according to claim 24, wherein said smoking article is a cigarette and said source of moisture-containing smoke is a tobacco rod.

* * * * *

UNITED STATES PATENT AND TRADEMARK OFFICE

CERTIFICATE OF CORRECTION

PATENT NO. : 4,715,390

DATED : December 29, 1987

INVENTOR(S) : Walt Nichols et al.

It is certified that error appears in the above-identified patent and that said Letters Patent is hereby corrected as shown below:

Column 4, line 2, "Tripping" should be -- Tipping --;

line 3, "overwaraps" should be -- overwraps --.

Claim 10, line 2, "claim 9" should be -- any one of claims 9 and 16 to 23 --.

Claim 23, line 1, "21" should be -- 22 --.

Signed and Sealed this

Seventh Day of February, 1989

*Attest:*

*Attesting Officer*

DONALD J. QUIGG

*Commissioner of Patents and Trademarks*